US011346142B2

(12) United States Patent
Srivastava et al.

(10) Patent No.: US 11,346,142 B2
(45) Date of Patent: May 31, 2022

(54) SMART WINDOW TO REDUCE HVAC LOAD

(71) Applicant: Toyota Motor Engineering & Manufacturing North America, Inc., Plano, TX (US)

(72) Inventors: Abhishek Srivastava, Ann Arbor, MI (US); David W. Cosgrove, Milford, MI (US)

(73) Assignee: TOYOTA MOTOR ENGINEERING & MANUFACTURING NORTH AMERICA, INC., Plano, TX (US)

( * ) Notice: Subject to any disclaimer, the term of this patent is extended or adjusted under 35 U.S.C. 154(b) by 37 days.

(21) Appl. No.: 16/824,049

(22) Filed: Mar. 19, 2020

(65) Prior Publication Data

US 2021/0293072 A1 Sep. 23, 2021

(51) Int. Cl.

| | |
|---|---|
| ***E05F 15/00*** | (2015.01) |
| ***E05F 15/70*** | (2015.01) |
| ***E05F 15/73*** | (2015.01) |
| ***E05F 15/71*** | (2015.01) |

(52) U.S. Cl.

CPC ..... *E05F 15/70* (2015.01); *E05F 15/71* (2015.01); *E05F 15/73* (2015.01); *E05Y 2900/55* (2013.01)

(58) Field of Classification Search

CPC ..... E05F 15/73; E05F 15/71; E05F 15/70; E05Y 2900/55; B60H 1/00792; B60H 1/008; B60H 1/00849; B60H 1/00828; B60H 2001/00721

USPC ..... 49/31; 454/75, 122, 123

See application file for complete search history.

(56) References Cited

U.S. PATENT DOCUMENTS

| | | | |
|---|---|---|---|
| 5,129,192 | A | 7/1992 | Hannush |
| 5,222,661 | A | 6/1993 | Wenhart |
| 5,259,814 | A | 11/1993 | Weissbrich et al. |
| 7,228,213 | B2 | 6/2007 | Sakai et al. |
| 8,169,311 | B1 | 5/2012 | Breed |
| 9,123,244 | B2 | 9/2015 | Daman et al. |
| 9,855,820 | B2 | 1/2018 | Baron, Jr. et al. |
| 9,919,646 | B1 | 3/2018 | Arnold et al. |
| 9,994,150 | B2 | 6/2018 | Appukutty et al. |
| 9,998,899 | B1 | 6/2018 | Tannenbaum |
| 10,427,503 | B2 | 10/2019 | Snider |
| 10,471,829 | B2 | 11/2019 | Yellambalase et al. |
| 10,493,952 | B1 | 12/2019 | Schwie et al. |
| 10,933,713 | B2 * | 3/2021 | Ferri ..... B60H 1/00828 |

(Continued)

*Primary Examiner* — Chi Q Nguyen

(74) *Attorney, Agent, or Firm* — Snell & Wilmer LLP

(57) ABSTRACT

Methods, systems, devices and apparatuses for an air management system that circulates air to reduce the cabin temperature within a vehicle. The air management system includes a window configured to allow air circulation within the vehicle. The air management system includes an actuator coupled to the window and configured to open or close the window to control an amount of air circulation. The air management system includes a sensor. The sensor is configured to measure or determine a cabin temperature within the vehicle. The air management system includes an electronic control unit. The electronic control unit is coupled to the actuator and the sensor and configured to determine, using the sensor, that the cabin temperature is greater than or equal to a first temperature and control the actuator to open the window and allow air circulation within the vehicle.

19 Claims, 5 Drawing Sheets

(56) References Cited

U.S. PATENT DOCUMENTS

| | | | | |
|---|---|---|---|---|
| 11,034,212 | B2 * | 6/2021 | Li | B60H 1/008 |
| 2006/0122753 | A1 * | 6/2006 | O'Brien | E05F 15/695 701/49 |
| 2008/0299884 | A1 * | 12/2008 | Moroto | B24D 5/14 451/548 |
| 2009/0130966 | A1 * | 5/2009 | Tucker | B60H 1/248 454/75 |
| 2010/0144261 | A1 * | 6/2010 | Barkic | B60H 1/00785 454/75 |
| 2011/0059341 | A1 * | 3/2011 | Matsumoto | H01M 10/613 429/82 |
| 2014/0373446 | A1 * | 12/2014 | Weidenbacher | E05F 15/74 49/31 |
| 2015/0217628 | A1 * | 8/2015 | Talarico | B60H 1/00264 454/75 |
| 2017/0234052 | A1 * | 8/2017 | Dudar | E05F 15/695 49/31 |
| 2018/0197027 | A1 | 7/2018 | Ali et al. | |
| 2019/0143794 | A1 * | 5/2019 | Ligi, Jr | B60H 1/00742 454/75 |
| 2019/0156605 | A1 | 5/2019 | Tang et al. | |
| 2019/0308487 | A1 * | 10/2019 | Badger, II | G07C 5/08 |
| 2021/0122214 | A1 * | 4/2021 | Buckman | B60H 1/00785 |

* cited by examiner

SMART WINDOW TO REDUCE HVAC LOAD

BACKGROUND

Field

This disclosure relates to a system, method, apparatus and/or device to manage air circulation within the vehicle to reduce the load and/or the amount of energy needed by the heating, ventilation and air conditioning (HVAC) unit of the vehicle during vehicle startup.

Description of the Related Art

When a vehicle is parked outside, the temperature within the cabin of the vehicle may increase because there is no airflow circulating within the cabin. A driver or other occupant of the vehicle may not enter the vehicle for a long duration and the temperature within the cabin will continue to increase because of the lack of circulation. Finally, when the driver or the other occupant of the vehicle returns to the vehicle, the cabin temperature may be very high, and so, the driver or the other occupant nay start the vehicle, activate the HVAC unit to circulate the air and/or cool the cabin. Since the temperature is already very high, the HVAC unit must run at an increased load to cool the cabin down rapidly. This requires a significant amount of energy, and the driver or other occupant experiences significant discomfort while waiting for the cabin to cool.

Accordingly, there is a need for a system, apparatus and/or method to reduce the load on the HVAC unit during vehicle startup to cool the cabin of the vehicle.

SUMMARY

In general, one aspect of the subject matter described in this disclosure may be embodied in an air management system. The air management system includes a window configured to allow air circulation within the vehicle. The air management system includes an actuator coupled to the window and configured to open or close the window to control ail amount of air circulation. The air management system includes a sensor. The sensor is configured to measure or determine a cabin temperature within the vehicle. The air management system includes an electronic control unit. The electronic control unit is coupled to the actuator and the sensor and configured to determine, using the sensor, that the cabin temperature is greater than or equal to a first temperature and control the actuator to open the window and allow air circulation within the vehicle.

These and other embodiments may optionally include one or more of the following features. The electronic control unit may be configured to determine a difference between the cabin temperature and the first temperature. The electronic control unit may be configured to control the actuator to open the window based on the difference. The electronic control unit may be configured to open the window a first amount when the cabin temperature is greater than a first temperature and less than a second temperature. The second temperature may be greater than the first temperature. The electronic control unit may be configured to open the window a second amount when the cabin temperature is greater than the second temperature.

The air management system may include a navigation unit. The navigation unit may be configured to detect or determine a location of the vehicle. The electronic control unit may be configured to control the actuator to open the window based on the location of the vehicle. The electronic control unit may be configured to send a request that requests a confirmation to open the window. The electronic control unit may be configured to control the actuator to open the window based on receipt of the confirmation to open the window.

The air management system ay include a second sensor. The second sensor may be configured to detect a presence or a lack of presence of a person within a threshold distance of the vehicle. The electronic control unit may be configured to control the actuator to open the window based on the presence or the lack of presence of the person within the threshold distance. The electronic control unit may be configured to control the actuator to close the window when the presence of the person is detected.

In another aspect of the subject matter may be embodied in an air management system. The air management system includes a window configured to allow air circulation. The air management system includes a first sensor configured to measure or detect a temperature within a vehicle. The air management system includes a processor coupled to the first sensor. The processor is configured to determine, using the sensor, that the temperature is greater than or equal to a threshold temperature, and open the window to allow air circulation when the temperature is greater than or equal to the threshold temperature.

In another aspect, the subject matter may be embodied in a method for controlling temperature within a vehicle. The method includes measuring, using a sensor a cabin temperature within the vehicle. The method includes determining, using the sensor, that the cabin temperature is greater than or equal to a first temperature. The method includes automatically opening, by a processor and using an actuator, a first window within the vehicle to allow air circulation within the vehicle when the ambient temperature is greater than or equal to the first temperature.

BRIEF DESCRIPTION OF THE DRAWINGS

Other systems, methods, features, and advantages of the present invention will be apparent to one skilled in the art upon examination of the following figures and detailed description. Component parts shown in the drawings are not necessarily to scale and may be exaggerated to better illustrate the important features of the present invention.

DETAILED DESCRIPTION

Disclosed herein are systems, apparatuses, and methods for an air management system in a vehicle to circulate air within the vehicle while the vehicle is off. The air management system controls or otherwise adjusts the position of one or more windows, such as the front and back passenger side windows, the front and back driver side windows, the sun or moon roof, a convertible top and/or the rear window, such as a drop-down back glass window, of a vehicle. The air circulation system measures the temperature within the cabin of the vehicle and determines whether the temperature is so hot that the temperature would cause an increased load on the HVAC unit when the vehicle is started. By adjusting the one or more windows to open or partially open, the air management system allows air to circulate within the vehicle while the vehicle is off, and thus, the air management system cools the cabin of the vehicle, which reduces the load on the HVAC unit during startup when the temperature is hot. Additionally, by reducing the load on the HVAC unit during vehicle startup and cooling the cabin temperature of the vehicle, the air management system improves the fuel economy and/or efficiency and allows the vehicle components to operate optimally during vehicle startup.

Other benefits and advantages include a safety feature that determines whether a person is in proximity of the vehicle before opening the one or more windows and closing the one or more windows when the person is in proximity of the vehicle. This prevents a suspicious person from accessing the vehicle. Additionally, the air management system may check the weather and close the one or more windows or prevent the one or more windows from opening when there is a significant likelihood of precipitation. This prevents rain or other precipitation from entering the vehicle.

Additionally, the air management system may either notify the driver that the cabin temperature is hot prior to opening the one or more windows or automatically open the one or more windows. The air management system may also consider other factors, such as the location of the vehicle, a presence or lack of presence of a person within the vehicle or outside near the vehicle, and/or user preferences, to determine whether to open the one or more windows. This allows the air management system to intelligently determine when to open or close the one or more windows, the number of windows to open and/or the amount to open the one or more windows.

Figure 1:
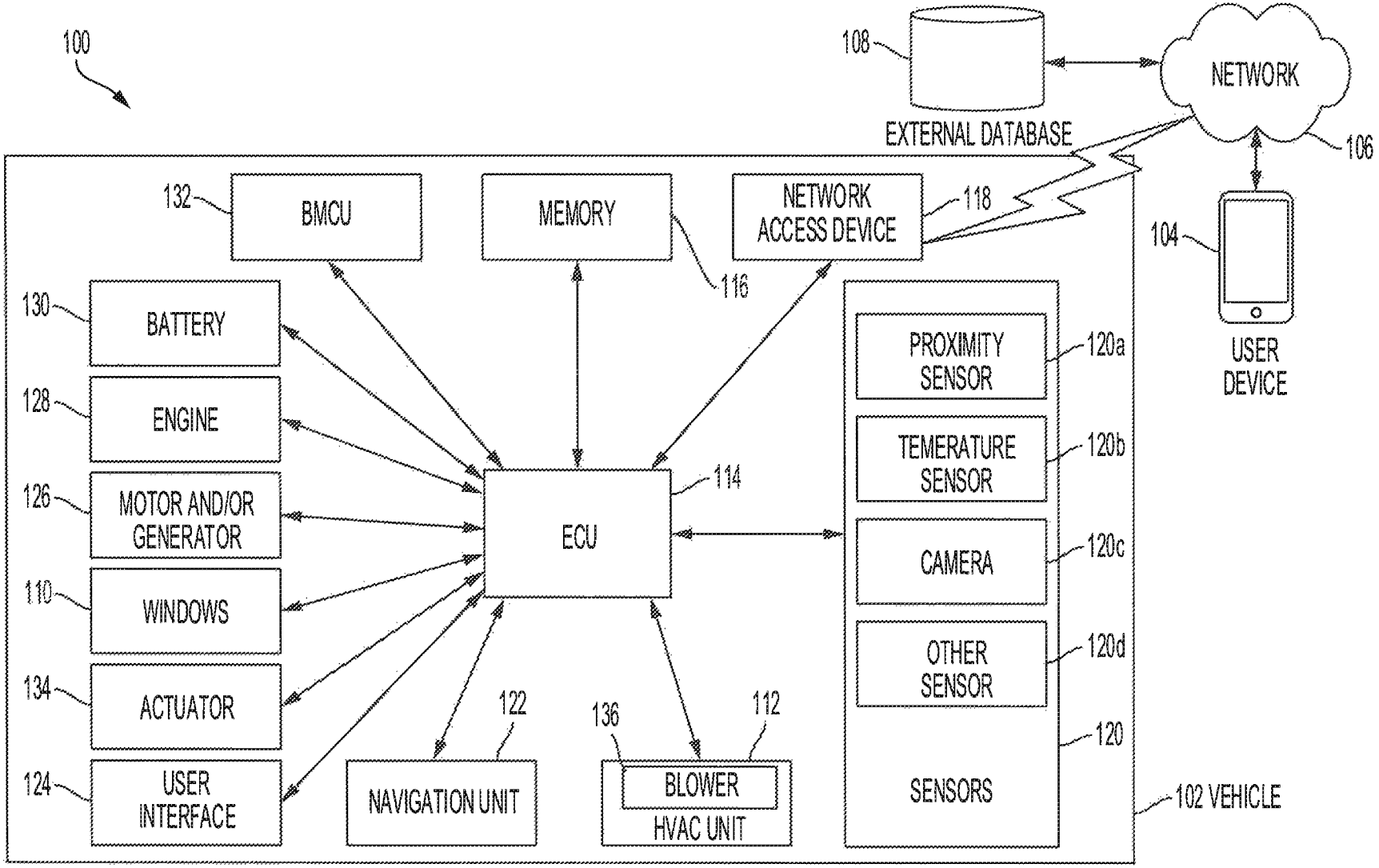
FIG. 1 is a block diagram of an example air management system according to an aspect of the invention.

FIG. 1 is a block diagram of an air management system 100. The air management system 100 may be retro-fitted, coupled to, integrated with, include or be included within a vehicle 102 or may be entirely separate from the vehicle 102. The air management system 100 may include or be coupled to a user device 104 and/or an external database 108. The user device 104 may be a personal device, a mobile device, such as a smartphone, a tablet other electronic device that may be display notifications, run applications or otherwise interact with the vehicle 102 via a wireless or a wired connection.

The air management system 100 may have or use a network 106 to communicate among different components, such as between the vehicle 102, the user device 104 and/or the external database 108. The network 106 may be a Dedicated Short-Range Communication (DSRC) network, a local area network (LAN), a wide area network (WAN), a cellular network, the Internet, or combination thereof, that connects, couples and/or otherwise communicates among the different components of the air management system 100.

The air management system 100 may include or be coupled to the external database 108. A database is any collection of pieces of information that is organized for search and retrieval, such as by a computer, and the database may be organized in tables, schemas, queries, reports, or any other data structures. A database may use any number of database management systems. The external database 108 may include a third-patty server or website that stores or provides information. The information may include real-time information, periodically updated information, or user-inputted information. A server may be a computer in a network that is used to provide services, such as accessing files or sharing peripherals, to other computers in the network.

The external database 108 may be a map or transportation database that tracks various structural features near roadways. The map or transportation database may include the locations of various structural features or overhead structures, such as parking structures, covered garage, trees, bridges, overpasses or other overhead structures that may form a shaded or covered area. The external database 108 may be a weather database that stores and/or provides weather information including the ambient temperature, weather, amount and/or likelihood of precipitation and/or other weather factors that may affect the vehicle 102.

The air management system 100 detects or measures the temperature inside the cabin of the vehicle and/or outside the vehicle along with other various parameters, such as the weather condition of the surrounding environment and/or surrounding structures or objects in proximity to the vehicle 102 and controls the operation of one or more windows 110 to circulate the flow of air within the cabin of the vehicle 102. By circulating the flow of air within the cabin of the vehicle 102, the air management system 100 may reduce the temperature within the cabin of the vehicle 102, and as such, the load on the HVAC unit 112 may be reduced during vehicle startup.

Various parameters, such as the structures or objects surrounding the vehicle, the weather near or in proximity to the vehicle 102, the temperature within the cabin of the vehicle 102 and/or the ambient temperature outside the vehicle 102, may present different reasons to open, close or otherwise operate the one or more windows 110 when the vehicle 102 is off. Thus, the air management system 100 accounts for these various factors to recommend an operation of the one or more windows 110 to the user device 104 and/or automatically operates the one or more windows 110.

The air management system 100 may include or be retro-fitted or integrated with the vehicle 102. The air management system 100 may include an electronic control unit 114, a memory 116, a network access device 118, one or more sensors 120, one or more windows 110 and/or one or more actuators 134. The air management system 100 may include or be coupled to one or more components of the vehicle 102, such as the HVAC unit 112, the navigation unit 122 and/or the user interface 124. The air management system 100 may include one or more other components of the vehicle 102, such as the motor and/or generator 126, the engine 128, the battery 130, and/or the battery management and control unit (BMCU) 132.

A vehicle 102 is a conveyance capable of transporting a person, an object, or a permanently or temporarily affixed apparatus. The vehicle 102 may be a self-propelled wheeled conveyance, such as a car, sports utility vehicle, truck, bus, van or other motor, battery or fuel cell driven vehicle. For example, the vehicle 102 may be an electric vehicle, a hybrid vehicle, a hydrogen fuel cell vehicle, a plug-in hybrid vehicle or any other type of vehicle that has a fuel cell stack, a motor and/or a generator. Other examples of vehicles include bicycles, trains, planes, or boats, and any other form of conveyance that is capable of transportation. The vehicle 102 may be semi-autonomous or autonomous. That is, the vehicle 102 may be self-maneuvering and navigate without human input. An autonomous vehicle may have and use one or more sensors and/or a navigation unit to drive autonomously.

The air management system 100 includes or couples to one or more processors, such as the electronic control unit (ECU) 114. The one or more processors, such as the ECU 114, may be implemented as a single processor or as multiple processors. For example, the ECU 114 may be a microprocessor, data processor, microcontroller or other controller, and may be electrically coupled to some or all the other components within the vehicle 102 and/or the air management system 100. The one or more processors may adjust the amount that each of the one or more windows 110 are opened, closed or otherwise moved to allow air to circulate within the cabin of the vehicle 102. The ECU 114 may be coupled to the memory 116.

The air management system 100 has a memory 116. The memory 116 may be coupled to the ECU 114 and store instructions that the ECU 114 executes. The memory 116 may include one or more of a Random Access Memory (RAM), Read Only Memory (ROM) or other volatile or non-volatile memory. The memory 116 may be a non-transitory memory or a data storage device, such as a hard disk drive, a solid-state disk drive, a hybrid disk drive, or other appropriate data storage, and may further store machine-readable instructions, which may be loaded and executed by the ECU 114. The memory 116 may store a mapping between a position of each of the one or more windows 110 and an amount of air circulation allowed into the cabin of the vehicle 102 and/or an amount of temperature reduction within the cabin of the vehicle 102.

The air management system 100 may include one or more windows 110. The one or more windows 110 of the vehicle 102 may include front and rear passenger and driver side windows, a sun roof, a moon roof, a rear window, such as a drop-down back glass window, or other window of the vehicle 102. The air management system 100 may have and use one or more actuators 134 in contact or coupled to the one or more windows 110 to move the one or more windows 110 up or down to open or close, respectively, the one or more windows 110. By opening the one or more windows 110, the air management system 100 circulates air within the cabin of the vehicle 102, which reduces the temperature within the cabin of the vehicle 102. Thus, the load on the HVAC unit 112 to decrease the temperature within the cabin of the vehicle 102 is reduced during vehicle startup.

The air management system 100 may include or be coupled to the HVAC unit 112, which has one or more blowers 136 that blow or circulate air within the cabin of the vehicle 102. When the vehicle 102 is off, the temperature within the vehicle 102 may increase on a warm day due to a lack of circulation. A driver or other occupant of the vehicle 102 may turn on the HVAC unit 112 upon vehicle startup, such as by using the air conditioner or vent, to cool the temperature within the cabin of the vehicle 102, which causes an increased load on the HVAC unit 112 and increases use of electrical energy. By opening the one or more windows 110, air may circulate within the cabin of the vehicle 102, and thus, reduce the temperature within the cabin of the vehicle 102 prior to vehicle startup.

The air management system 100 may include one or more sensors 120. The one or more sensors 120 may include a proximity sensor 120*a*, a temperature sensor 120*b*, a camera 120*c* and/or one or more other sensors 120*d*. The proximity sensor 120*a* mad use LIDAR, radar, infrared, or other signal to detect one or more objects within a proximity, such as threshold distance of approximately 10-15 feet, of the vehicle 102. The temperature sensor 120*b* may be an internal temperature sensor that measures the temperature of the cabin of the vehicle 102 (or "cabin temperature") and/or may be an external temperature sensor that measures the ambient temperature of the surrounding environment external to the vehicle 102.

The camera 120*c* may be an external camera that captures image data of the surrounding environment external to the vehicle 102. The image data may capture structures or objects surrounding the vehicle 102, which may be used to identify objects approaching the vehicle 102 and/or structures providing shade to the vehicle 102. The camera 120*c* may be an internal camera within the cabin of the vehicle 102. The one or more cameras 120*c* may be used to capture image data within the cabin of the vehicle 102 to determine whether there are occupants within the vehicle 102. The one or more other sensors 120*d* may be a humidity sensor that detects precipitation or humidity within the surrounding environment and/or an internal sensor that detects one or more occupants within the vehicle 102.

The air management system 100 may have a user interface 124 and/or a network access device 118. The user interface 124 may receive user input that indicates one or more configuration settings, which indicate whether the air management system 100 automatically opens and/or closes the one or more windows 110 and/or notifies the user device 104 to request for instructions to perform one or more operations to the one or more windows 110.

The user interface 124 may include an input/output device that receives user input from a user interface element, a button, a dial, a microphone, a keyboard, or a touch screen. The user interface 124 may provide an output to an output device, such as a display, a speaker, an audio and/or visual indicator, or a refreshable braille display.

The network access device 118 may include a communication port or channel, such as one or more of a Dedicated Short-Range Communication (DSRC) unit, a Wi-Fi unit, Bluetooth® unit, a radio frequency identification (REID) tag or reader, or a cellular network unit for accessing a cellular network (such as 3G, 4G or 5G). The network access device 118 may transmit data to and receive data from the different components of the different entities of the air management system 100, such as the user device 104, and/or the vehicle 102.

The one or more vehicle components may include a navigation unit 122. The navigation unit 122 may be integral to the vehicle 102 or a separate unit coupled to the vehicle 102. The vehicle 102 may include a Global Positioning System (GPS) unit (not shown) for detecting location data including a current location of the vehicle 102 and date/time information instead of the navigation unit 122. In that regard, the ECU 114 may perform the functions of the navigation unit 122 based on data received from the GPS unit. The navigation unit 122 or the ECU 114 may perform navigation functions. Navigation functions may include, for example, route and route set prediction, providing navigation instructions, and receiving user input such as verification of predicted routes and route sets or destinations.

The one or more vehicle components may include a motor and/or generator 126. The motor and/or generator 126 may convert electrical energy into mechanical power, such as torque, and may convert mechanical power into electrical energy. The motor and/or generator 126 may be coupled to the battery 130. The motor and/or generator 126 may convert the energy from the battery 130 into mechanical power, and may provide energy back to the battery 130, for example, via regenerative braking. The vehicle 102 may include one or more additional power generation devices such as the engine 128 or a fuel cell stack (not shown). The engine 128 combusts fuel to provide power instead of and/or in addition to the power supplied by the motor and/or generator 126.

The battery 130 may be coupled to the motor and/or generator 126 and may supply electrical energy to and receive electrical energy from the motor and/or generator 126. The battery 130 may include one or more rechargeable batteries and may supply the power to the air management system 100 even when the vehicle 102 is off.

The BMCU 132 may be coupled to the battery 130 and may control and manage the charging and discharging of the battery 130. The BMCU 132, for example, may measure, using battery sensors, parameters used to determine the state of charge (SOC) of the battery 130. The BMCU 132 may control the battery 130.

Figure 2:
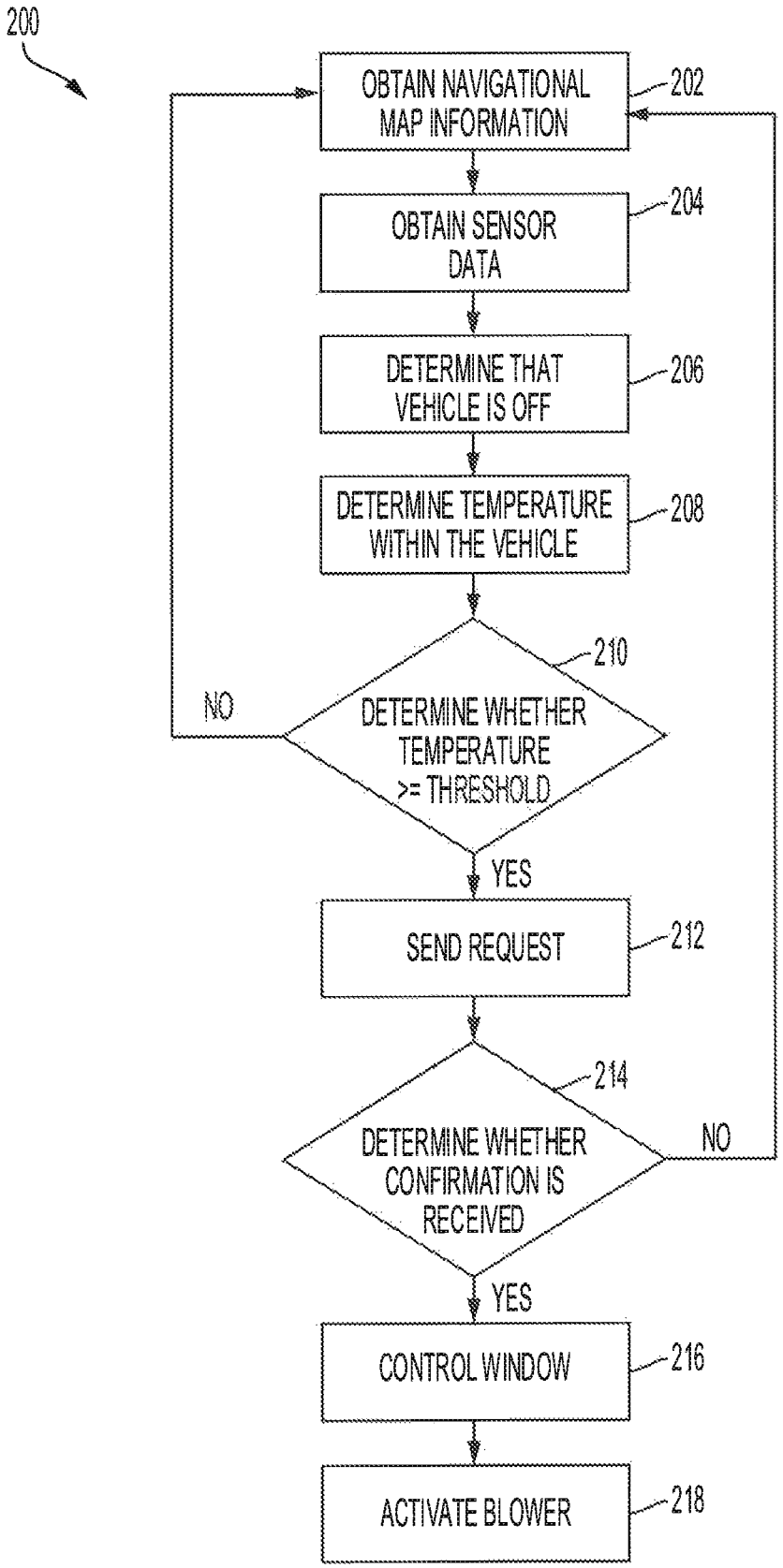
FIG. 2 is a flow diagram of an example process for opening one or more windows to circulate air within the cabin and reduce the load on the HVAC unit during vehicle startup using the air management system of FIG. 1 according to an aspect of the invention.

FIG. 2 is a flow diagram of a process 200 for opening one or more windows 110 to circulate air within the cabin of the vehicle 102. One or more computers or one or more data processing apparatuses, for example, the ECU 114 of the air management system 100 of FIG. 1, appropriately programmed, may implement the process 200.

The air management system 100 may obtain navigational map information (202). The navigational map information may include a current location of the vehicle 102 and/or identify the locations of one or more structures or objects near the current location of the vehicle 102. In some implementations, the air management system 100 may provide the current location of the vehicle 102 to the external database 108 and obtain the locations of the one or more structures or objects near the current location of the vehicle 102. The one or more structures or objects may deflect sunlight and/or provide shade to the vehicle 102.

The air management system 100 may obtain sensor data (204). The air management system 100 may use the one or more sensors 120 to obtain sensor data of the surrounding environment external to the vehicle 102 and/or internal within the cabin of the vehicle 102. The sensor data may include a presence or a lack of presence of an object or person within a threshold distance of the vehicle 102, a likelihood or probability of precipitation and/or a presence or a lack of presence of a person within the cabin of the vehicle 102 among other factors or parameters.

For example, the air management system 100 may use a proximity sensor 120*a* and/or a camera 120*c* to detect or capture image data of one or more objects, such as a person, within the surrounding environment of the vehicle 102, such as within a threshold distance. In another example, the air management system 100 may use one or more other sensors 120*d*, such as a humidity sensor, to detect precipitation and/or a likelihood of precipitation at the current location of the vehicle 102. In another example, the air management system 100 may detect the presence or lack of presence of one or more driver or occupants within the vehicle 102.

In some implementations, the air management system 100 may use a temperature sensor 120*b* to measure or detect temperature of the surrounding external environment of the vehicle 102 (or "ambient temperature"). The air management system 100 may use the ambient temperature as one factor in determining whether to open or close the one or more windows 110. For example, circulating hotter or warmer ambient temperature into the vehicle 102 may increase the temperature within the cabin of the vehicle 102, and thus, the air management system 100 may not open the one or more windows 110 to circulate air with an ambient temperature greater than the cabin temperature. In some implementations, the air management system 100 provides the current location of the vehicle 102 to an external database 108 and obtains the ambient temperature of the current location of the vehicle 102 from the external database 108.

The sensor data may include engine sensor data and/or ignition data that indicates the state of the engine 128 and/or the presence or lack of presence of the key within the vehicle 102, respectively. The sensor data may be used to open, close or otherwise control the one or more windows 110 and/or activate the air management system 100.

The air management system 100 determines that the vehicle 102 is off (206). The air management system 100 may use sensor data from one or more other sensors 120*d*, such as an engine sensor, to detect a state of the engine 128 to determine whether the vehicle 102 is off. For example, the engine sensor may detect that the engine is off, and thus, the air management system 100 may determine that the vehicle 102 is off. The one or more other sensors 120*d* may include a key sensor. The key sensor may detect whether the key is inserted into the ignition or the key fob is present within the vehicle 102 to determine whether the vehicle 102 is off. For example, the key sensor may detect that the key is not present in the ignition or the key fob is not within the vehicle 102 to determine that the vehicle 102 is off.

The air management system 100 determines the temperature within the cabin of the vehicle 102 (208). The air management system 100 may use a temperature sensor 120*b* to measure or detect the cabin temperature. The temperature sensor 120*b* measures or detects the cabin temperature to be used to determine whether to open or close the one or more windows 110.

Once the air management system 100 determines the cabin temperature, the air management system 100 determines whether the cabin temperature is greater than or equal to a threshold temperature (210). The threshold temperature may be a temperature that causes an increased load on the HVAC unit 112 during vehicle startup. The threshold temperature may be approximately 75° F.-85° F. The threshold temperature may be pre-configured and/or user-inputted via the user interface 124.

If the air management system 100 determines that the cabin temperature is less than the threshold temperature, the cabin temperature may not cause an increased load on the HVAC unit 112 during vehicle startup because the cabin temperature is within a comfortable range of the driver and/or occupant. And as such, the air management system 100 may continue to monitor the cabin temperature and/or other sensor data (204). If the air management system 100 determines that the cabin temperature is greater than or equal to the threshold temperature, the air management system 100 controls the one or more windows 110 either automatically or after user confirmation from a driver or other occupant via the user device 104.

When the cabin temperature is greater than or equal to the threshold temperature, the air management system 100 may send a request to a user, such as the driver or the occupant of the vehicle 102, for confirmation to open the one or more windows 110 (212). The request may include an indication that the cabin temperature is greater than or equal to the threshold temperature and a confirmation request to open, control or otherwise operate the one or more windows 110. In some implementations, the air management system 100 does not send the request but automatically controls the one or more windows.

When the air management system 100 sends the request and requires a confirmation, the air management system 100 may determine whether the confirmation is received (214). The air management system 100 may receive the confirmation to control, open or otherwise operate the one or more windows 110 and may proceed with controlling the one or more windows 110 (216). Otherwise, when the air management system 100 does send the request and requires the confirmation but does not receive the confirmation, the air management system 100 may continue to monitor the cabin temperature and/or sensor data (204).

Figure 3:
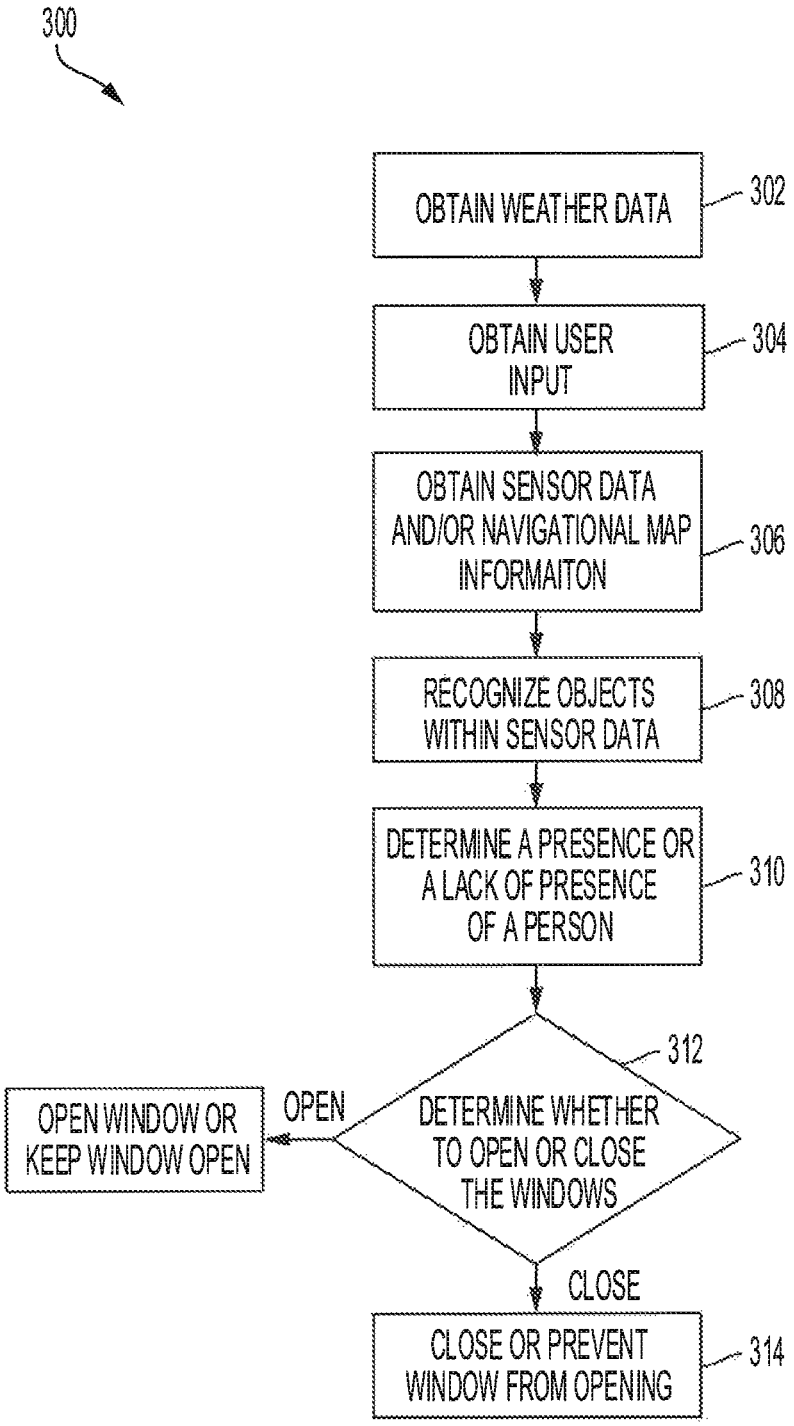
FIG. 3 is a flow diagram of an example process for closing the one or more windows and/or preventing the one or more windows from opening using the air management system of FIG. 1 according to an aspect of the invention.
Figure 4:
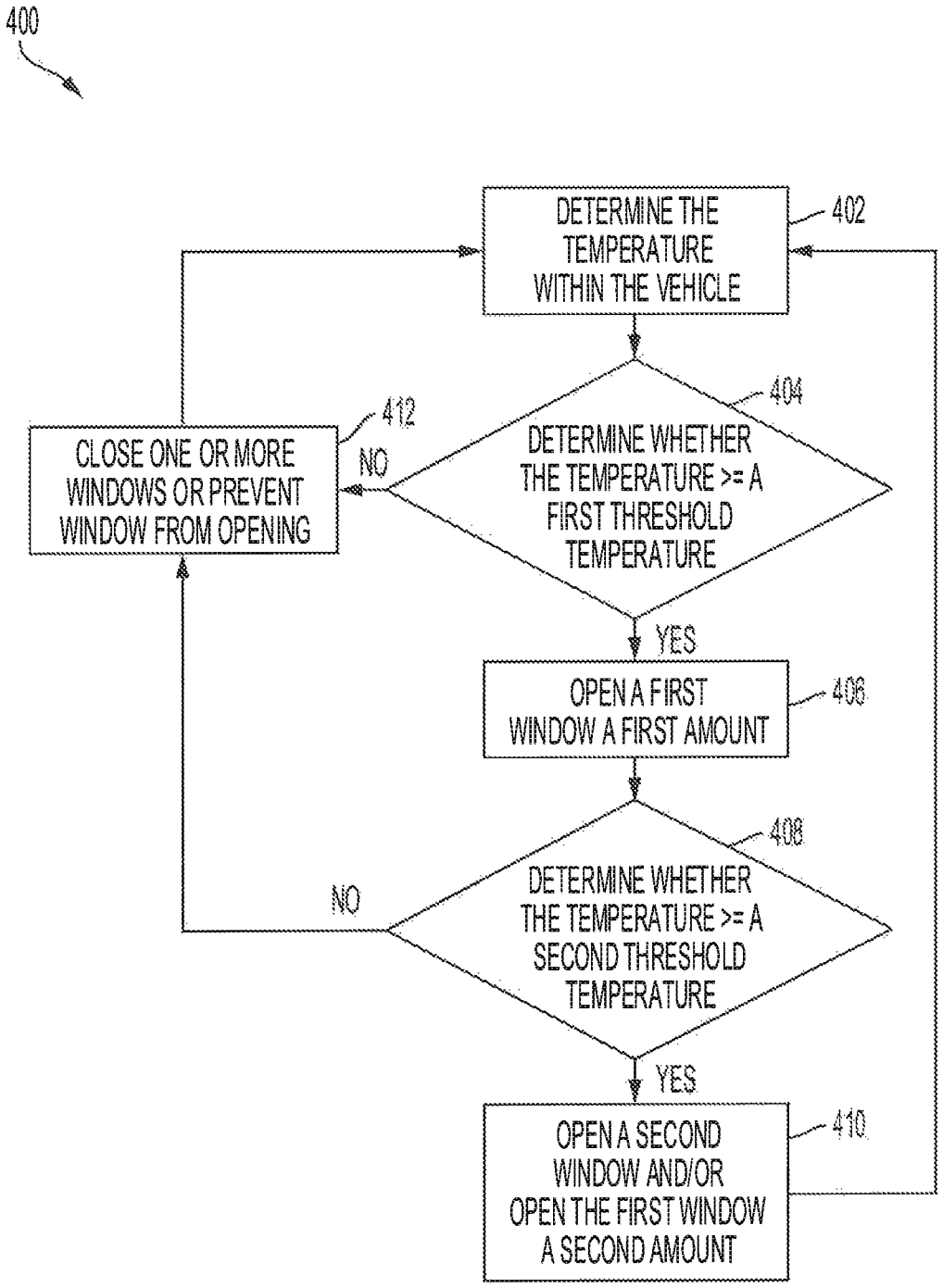
FIG. 4 is a flow diagram of an example process for determining an amount to open or close the one or more windows of the vehicle using the air management system of FIG. 1 according to an aspect of the invention.

When the confirmation request is received or is not needed, the air management system 100 controls the one or more windows 110 to circulate air within the cabin of the vehicle 102 when the cabin temperature is greater than or equal to the threshold temperature (216), The air management system 100 may draw power from the battery 130 of the vehicle 102 to open the one or more windows 110. The control of the one or more windows 110 may include determining which windows to open, the number of windows to open, the amount to open each of the one or more windows 110 and whether to close the one or more windows 110 or prevent the one or more windows 110 from opening. The control of the one or more windows 110 may be based on the sensor data, such as the ambient temperature and other factors including the location of the vehicle 102, the locations of the one or more structures or objects, which may provide shade, and/or the proximity of other identified objects, such as the presence or lack of presence of a person within a threshold distance of the vehicle 102. FIGS. 3-4 further describe the control of the one or more windows 110.

When the cabin temperature continues to rise or is excessively hot, such as above an even higher threshold temperature, the air management system 100 may activate one or more blowers 136 of the HVAC unit 112 (218). This will further circulate air, cool the cabin of the vehicle 102 and decrease the cabin temperature. In some implementations, the air management system 100 may automatically activate the one or more blowers 136 of the HVAC unit 112 concurrently or simultaneously when the one or more windows 110 are opened. The speed of the blower may be based on the amount that the cabin temperature exceeds the threshold temperature.

FIG. 3 is a flow diagram of a process 300 for closing the one or more windows 110 and/or preventing the one or more windows 110 from opening. One or more computers or one or more data processing apparatuses, for example, the ECU 114 of the air management system 100 of FIG. 1, appropriately programmed, may implement the process 300.

In some instances, once the air management system 100 determines that the cabin temperature is greater than or equal to the threshold temperature, a driver or owner of the vehicle 102 may not want the air management system 100 to automatically open the one or more windows 110 and/or would want the air management system 100 to automatically close the one or more windows 110. For example, when a suspicious person approaches the vehicle 102, one would not want the one or more windows 110 to be open and give the suspicious person access to the vehicle 102. The air management system 100 is designed to intelligently predict these instances and close or prevent the one or more windows from opening.

The air management system 100 may obtain weather data or information (302). The air management system 100 may provide a current location of the vehicle 102 to an external database 108 and obtain the weather data. In some implementations, the air management system 100 may use one or more sensors 120 to obtain weather data, such as using a humidity sensor to detect precipitation. The weather data may include an amount or a likelihood of precipitation, an amount of wind, dust, particulate or pollen within the air and/or an ambient temperature of the surrounding environment of the vehicle 102. The weather data may be used to determine whether to close or keep closed the one or more windows 110.

The air management system 100 may obtain user input (304). The user input may include a confirmation or denial of the confirmation request that indicates whether the driver, occupant or other user of the vehicle 102 desires to have the one or more windows 110 open when the air management system 100 requests confirmation of the opening of the one or more windows 110.

The air management system 100 may obtain sensor data and/or navigational map information, as described above (306). The sensor data may include image data of one or more objects within the surrounding environment of the vehicle 102, e.g., within a threshold distance of the vehicle 102. The one or more objects may include one or more structures, such as a nearby vehicle, tree, bridge, overhead or other structure, which may supply shade and reduce the ambient temperature surrounding the vehicle 102. The one or more objects may include a person, animal or other animated object that is moving. The sensor data may include information relates to the one or more objects including a relative distance between the object and the vehicle 102 along with a rate of change of the relative distance. This allows the air management system 100 to detect whether the object is approaching the vehicle 102 when the relative distance is decreasing.

The navigational map information may include the current location of the vehicle 102 and/or the locations of one or more structures within a threshold distance of the current location of the vehicle 102. When a structure is close or within the threshold distance, this may indicate that the structure may provide shade, which may indicate that the cabin temperature is cooler than the outside ambient temperature, for example.

Once the sensor data and/or navigational map information is obtained, the air management system 100 recognizes objects within the sensor data (308). The air management system 100 may outline various objects and compare the objects to a library of objects to identify and recognize the objects. For example, the air management system 100 may recognize the one or more structures surrounding the vehicle 102 to determine whether the one or more structures provide shade and/or reduce the cabin temperature of the vehicle 102, such as when the vehicle 102 is beneath a tree or between vehicles that block the sunlight. In another example, the air management system 100 may detect or determine whether one of the recognized objects is a person.

The air management system 100 may determine a presence or a lack of a presence of a person surrounding the vehicle 102 (310). The air management system 100 may analyze the recognized objects within a threshold distance of the vehicle 102. Based on the recognized objects, the air management system 100 may determine whether a person is or is not present surrounding the vehicle 102.

The air management system 100 determines whether to open or close the one or more windows 110 (312). The determination may be based on various factors including the user input, sensor data including the presence or lack of the presence of the person and the weather data. When the user input indicates that the driver or occupant does not want the one or more windows 110, the air management system 100 may automatically close any of the one or more windows 110 that are open and prevent all of the one or more windows 110 from opening. The user input may override any of the other factors.

In some implementations, the air management system may also determine to close the one or more windows 110 or prevent the one or more windows 110 from opening when the sensor data and/or the weather data indicates that some type of precipitation may occur, such as when the likelihood of precipitation is greater than a threshold amount, or that there is a large amount of particulates in the air, such as when the amount of particulates is greater than a threshold amount.

The air management system 100 may close the one or more windows 110 or prevent the one or more windows 110 from opening when the ambient temperature is greater than the cabin temperature. The air management system 100 may not want warmer air from entering as that may increase the load on the HVAC unit 112 during vehicle startup. Whereas, when the ambient temperature is less than the cabin temperature and when there is no likelihood of precipitation and/or particulates, the air management system 100 is more likely to open the one or more windows 110. This allows the air management system 100 to prevent particulates, precipitation and/or warmer air from entering the vehicle 102.

In some implementations, the air management system 100 may also determine to close the one or more windows 110 or prevent the one or more windows 110 from opening based on the presence or the lack of presence of a person within a threshold distance of the vehicle 102. The air management system 100 may close or prevent the one or more windows 110 from opening when the person is present within the threshold distance of the vehicle 102. When there is no one present, then the air management system 100 may determine that the environment safe to open the one or more windows 110. This is a safety feature to prevent the person from having or gaining access to the vehicle 102.

When the air management system 100 determines to close or prevent the one or more windows 110 from opening, the air management system 100 may control one or more actuators 134 coupled to the one or more windows 110 to roll up or close the one or more windows 110 (314). Whereas, when the air management system 100 determines to open the one or more windows 110, the air management system 100 may control one or more actuators 134 coupled to the one or more windows 110 to roll down or open the one or more windows 110 (316). FIG. 4 further describes the process 400 for determining an amount to open or close the one or more windows 110.

FIG. 4 is a flow diagram of a process 400 for determining an amount to open or close the one or more windows 110. One or more computers or one or more data processing apparatuses, for example, the ECU 114 of the air management system 100 of FIG. 1, appropriately programmed, may implement the process 400.

The air management system 100 determines the temperature within the cabin of the vehicle 102, as described above (402). Once the cabin temperature is determined, the air management system 100 may compare the cabin temperature to a first threshold temperature and determine whether the cabin temperature is greater than or equal to the first threshold temperature (404). The determination may be based on the comparison. The first threshold temperature may be approximately 80° F.-85° F. The first threshold temperature may represent or correspond to a range of an increased load on the HVAC unit 112, such as an approximately 10% increase in load, during vehicle startup.

Figure 5:
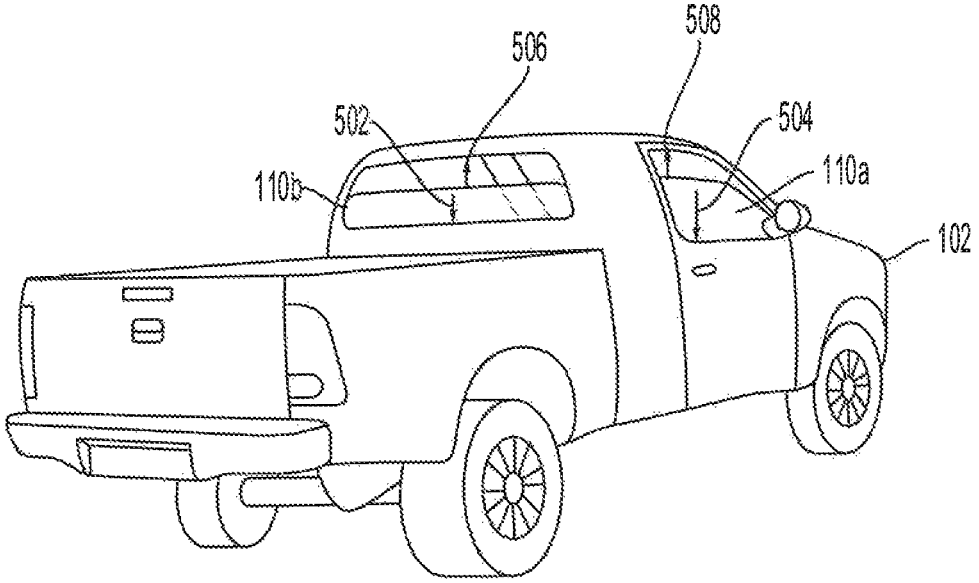
FIG. 5 shows the vehicle using the air management system of FIG. 1 to open and close one or more windows to circulate air within the vehicle and reduce the load on the HVAC unit during vehicle startup according to an aspect of the invention.

When the cabin temperature is less than the first threshold temperature, the air management system 100 may close the one or more windows 110 and/or prevent the one or more windows 110 from opening (412). The air management system 100 may detect a current position of the one or more windows 110 and may move the one or more actuators 134 to close or roll-up the one or more windows 110 when the one or more windows 110 are at least partially open. For example, if the rear window 110*b* of the vehicle 102 is open, the air management system 100 may move the rear window 110*b* in the upward direction 506 to close the rear window 110*b*, as shown in FIG. 5 for example. When the one or more windows 110 are already closed, the air management system 100 may not move the one or more actuators 134.

When the cabin temperature is greater than or equal to the first threshold temperature, the air management system 100 may open a first window a first amount (406). The air management system 100 may select which of the one or more windows 110 to open. For example, the air management system 100 may move the rear window 110*b* of the vehicle 102 downward in the direction 502. The first amount may be based on user input, such as from the confirmation request, user settings or a default setting. For example, as described above, the air management system 100 may receive a confirmation request from the user prior to opening the one or more windows 110 and the confirmation request may include which of the one or more windows 110 to open. The air management system 100 may determine the first amount to open the first window based on a user setting, user input and/or a difference between the cabin temperature and the first threshold temperature, e.g., by using a mapping between the difference and an amount to open a window stored in the memory 116.

The first amount may also be based on other factors, such as the ambient temperature surrounding the vehicle 102 and/or the likelihood of precipitation. When the ambient temperature is much cooler than the cabin temperature, less air circulation is necessary to cool the vehicle 102, and so, the window may be opened a smaller amount than when the ambient temperature is warmer. Similarly, if there is a greater probability or likelihood of precipitation the amount that the window is opened may be restricted to a small crack, such as being rolled down only approximately 5% to prevent precipitation from entering the vehicle 102.

Once the first window is opened, the air management system 100 may determine whether the cabin temperature is greater than or equal to a second threshold temperature (408). The air management system 100 may wait or delay a period of time to allow an opportunity for the air outside the vehicle 102 to circulate within the cabin of the vehicle 102, and then, measure the cabin temperature again to determine whether there is a change in the cabin temperature, e.g., a decrease in cabin temperature. The air management system 100 may compare the cabin temperature after the period of time to a second threshold temperature and determine whether the temperature is greater than or equal to the second threshold temperature based on the comparison. The second threshold temperature may be slightly less than the first threshold temperature, such as approximately 75° F.-80° F. When the cabin temperature has not cooled below the second threshold temperature within the delay, this may indicate that the cabin temperature is not cooling enough to reduce the load on the HVAC unit 112 during vehicle startup, and so, additional air circulation may be needed.

In some implementations, there is no delay and the air management system 100 does not wait the period of time and compares the cabin to the second threshold temperature immediately or concurrently with the comparison with the first threshold temperature. The second threshold temperature may be greater than the first threshold temperature, such as approximately 90° F.-95° F. When the cabin temperature is extremely hot, this may indicate that opening only a first window a first amount is not sufficient to reduce the load on the HVAC unit 112 during vehicle startup, and so, additional circulation may be needed.

When the cabin temperature is less than the second threshold temperature, the air management system 100 may close the one or more windows 110 and/or prevent the one or more windows 110 from opening, as described above (412). For example, the air management system 100 may close the passenger window 110*a* or the rear window 110*b* by moving the passenger window 110*a* in the upward direction 508 and/or the rear window 110*b* in the upward direction 506 to reduce the amount that the one or more windows 110 are open. When the cabin temperature is greater than or equal to the second threshold temperature, the air management system 100 may open a second window and/or open the first window a second amount (410). For example, the air management system 100 may open the passenger window 110*a* along with the rear window 110*b* or open either the passenger window 110*a* or the rear window 110*b* a greater amount, e.g., by moving the passenger window 110*a* or the rear window 110*b* downward in the directions 504, 502 respectively.

The second amount may be greater than the first amount. Similar to opening the first window, the air management system 100 may select which of the one or more windows 110 to open based on a user setting, user input and/or a difference between the cabin temperature and the first threshold temperature, e.g., by using a mapping between the difference and an amount to open a window stored in the memory 116. The different amounts to open, close or otherwise position the one or more windows 110 along with the which of the one or more windows 110 to open may be based on a mapping stored in and obtained from the memory 116.

Exemplary embodiments of the invention have been disclosed in an illustrative style. Accordingly, the terminology employed throughout should be read in a non-limiting manner. Although minor modifications to the teachings herein will occur to those well versed in the art, it shall be understood that what is intended to be circumscribed within the scope of the patent warranted hereon are all such embodiments that reasonably fall within the scope of the advancement to the art hereby contributed, and that that scope shall not be restricted, except in light of the appended claims and their equivalents.

What is claimed is:

1. An air management system for a vehicle, comprising:
- a window configured to allow air circulation within the vehicle;
- an actuator coupled to the window and configured to open or close the window to control an amount of the air circulation within the vehicle;
- a first sensor configured to measure or determine a cabin temperature within the vehicle;
- a second sensor configured to detect a presence or a lack of presence of a person within a threshold distance of the vehicle; and
- an electronic control unit (ECU) coupled to the actuator, the first sensor, and the second sensor, and configured to:
  - determine, using the first sensor, that the cabin temperature is greater than or equal to a first temperature,
  - control the actuator to open the window and allow the air circulation within the vehicle in response to the determination that the cabin temperature is greater than or equal to the first temperature and a detection, by the second sensor, of the lack of presence of the person within the threshold distance of the vehicle, and
  - control the actuator to close the window in response to a detection, by the second sensor, of the presence of the person within the threshold distance of the vehicle.

2. The air management system of claim 1, wherein the ECU is further configured to:
- determine a difference between the cabin temperature and the first temperature; and
- control the actuator to open the window based on the difference.

3. The air management system of claim 2, wherein to control the actuator to open the window based on the difference, the ECU is configured to:
- open the window a first amount when the cabin temperature is greater than the first temperature and less than a second temperature greater than the first temperature; and
- open the window a second amount when the cabin temperature is greater than the second temperature.

4. The air management system of claim 1, further comprising:
- a navigation unit configured to detect or determine a location of the vehicle; and
- wherein the ECU is further configured to control the actuator to open the window based on the location of the vehicle.

5. The air management system of claim 1, wherein the ECU is further configured to:
- send a request for a confirmation to open the window.

6. The air management system of claim 5, wherein the ECU is further configured to control the actuator to open the window based on receipt of the confirmation to open the window.

7. An air management system for a vehicle, comprising:
- a window configured to allow air circulation;
- a first sensor configured to measure or detect a temperature within the vehicle;
- a second sensor configured to detect a presence of a person within a threshold distance of the vehicle; and
- a processor coupled to the first sensor and the second sensor and configured to:
  - determine, using the first sensor, that the temperature within the vehicle is greater than or equal to a threshold temperature,
  - open the window to allow the air circulation when the temperature within the vehicle is greater than or equal to the threshold temperature, and
  - close the window in response to a detection, by the second sensor, of the presence of the person within the threshold distance of the vehicle.

8. The air management system of claim 7, wherein the processor is further configured to:
- obtain weather information that includes a likelihood of precipitation; and
- close the window when the likelihood of precipitation is greater than or equal to a threshold probability.

9. The air management system of claim 7, further comprising:
- a navigation unit configured to obtain a current location of the vehicle; and wherein the processor is further configured to open the window to allow the air circulation based on the current location of the vehicle.

10. The air management system of claim 7, further comprising:

an actuator coupled to the window and configured to open or close the window to control an amount of the air circulation; and wherein the processor is coupled to the actuator and further configured to control the actuator to open or close the window.

11. The air management system of claim 7, wherein:

the second sensor is further configured to detect a lack of presence of the person within the threshold distance of the vehicle; and the processor is further configured to open the window when the second sensor detects the lack of presence of the person within the threshold distance of the vehicle and the temperature within the vehicle is greater than or equal to the threshold temperature.

12. The air management system of claim 7, wherein the processor is further configured to:

send an activation request that requests a confirmation to open the window; and open the window when the temperature within the vehicle is greater than or equal to the threshold temperature and in response to receipt of the confirmation to open the window.

13. The air management system of claim 7, further comprising:

a heating, ventilation and air conditioning (HVAC) unit configured to adjust the temperature within the vehicle; and wherein the opening of the window increases air flow, reduces the temperature within the vehicle and reduces a load on the HVAC unit during startup.

14. The air management system of claim 7, wherein the processor is further configured to:

close the window when the temperature within the vehicle is less than the threshold temperature.

15. An air management system for a vehicle, comprising:

a window configured to allow air circulation;

a first sensor configured to measure or detect a temperature within the vehicle;

a second sensor configured to measure or detect an ambient temperature of a surrounding environment of the vehicle;

a third sensor configured to detect a presence of a person within a threshold distance of the vehicle; and a processor coupled to the first sensor, the second sensor, and the third sensor, and configured to:

determine, using the first sensor, that the temperature within the vehicle is greater than or equal to a threshold temperature, open the window to allow the air circulation when the temperature within the vehicle is greater than or equal to the threshold temperature and the ambient temperature is less than the temperature within the vehicle, and close the window in response to a detection, by the third sensor, of the presence of the person within the threshold distance of the vehicle.

16. The air management system of claim 15, wherein the processor is further configured to:

close the window when the temperature within the vehicle is less than the threshold temperature.

17. The air management system of claim 15, further comprising:

an actuator coupled to the window and configured to open or close the window to control an amount of the air circulation; and wherein the processor is coupled to the actuator and further configured to control the actuator to open or close the window.

18. The air management system of claim 15, wherein the processor is further configured to:

obtain or detect a likelihood of precipitation; and close the window when the likelihood of precipitation is greater than or equal to a threshold probability.

19. The air management system of claim 15, wherein:

the third sensor is further configured to detect a lack of presence of the person within the threshold distance; and the processor is further configured to open the window when the third sensor detects the lack of presence of the person within the threshold distance, the temperature within the vehicle is greater than or equal to the threshold temperature, and the ambient temperature is less than the temperature within the vehicle.

* * * * *